United States Patent [19]

Wiemer

[11] Patent Number: 4,513,694

[45] Date of Patent: Apr. 30, 1985

[54] VERTICAL RADIATION TANK

[76] Inventor: Willem Wiemer, No. 2 Veldmolen, 7491 Gn Delden, Netherlands

[21] Appl. No.: 589,109

[22] PCT Filed: Jul. 12, 1983

[86] PCT No.: PCT/NL83/00026

§ 371 Date: Feb. 17, 1984

§ 102(e) Date: Feb. 17, 1984

[87] PCT Pub. No.: WO84/00411

PCT Pub. Date: Feb. 2, 1984

[30] Foreign Application Priority Data

Jul. 12, 1982 [NL] Netherlands ..... 8202818

[51] Int. Cl.[3] ..... F22D 1/00; C10J 3/48

[52] U.S. Cl. ..... 122/7 R; 48/77; 55/222; 122/6 A; 122/235 A

[58] Field of Search ..... 122/7 R, 6 A, 5, 235 A; 48/77, 67; 55/222

[56] References Cited

U.S. PATENT DOCUMENTS

| | | | |
|---|---|---|---|
| 3,842,904 | 10/1974 | Gardenier | 122/7 R |
| 3,951,198 | 4/1976 | Ross et al. | 55/222 |
| 4,309,196 | 1/1982 | Vollhardt | 122/7 R |
| 4,314,826 | 2/1982 | Vollhardt | 48/67 |
| 4,372,253 | 2/1983 | Hibbel et al. | 122/7 R |
| 4,377,132 | 3/1983 | Koog et al. | 122/7 R |
| 4,395,268 | 7/1983 | Zabelka | 48/67 |
| 4,446,820 | 5/1984 | Jansing et al. | 122/6 A |
| 4,466,384 | 8/1984 | Maurer et al. | 122/7 R |
| 4,478,606 | 10/1984 | Dorling et al. | 122/7 R |

*Primary Examiner*—Henry C. Yuen

*Attorney, Agent, or Firm*—Diller, Ramik & Wight

[57] ABSTRACT

Vertical radiation tank for gaining heat from process gases.

A special performance of the diaphragm pipe walls has been chosen in order to avoid that ash swept along is solidified.

3 Claims, 3 Drawing Figures

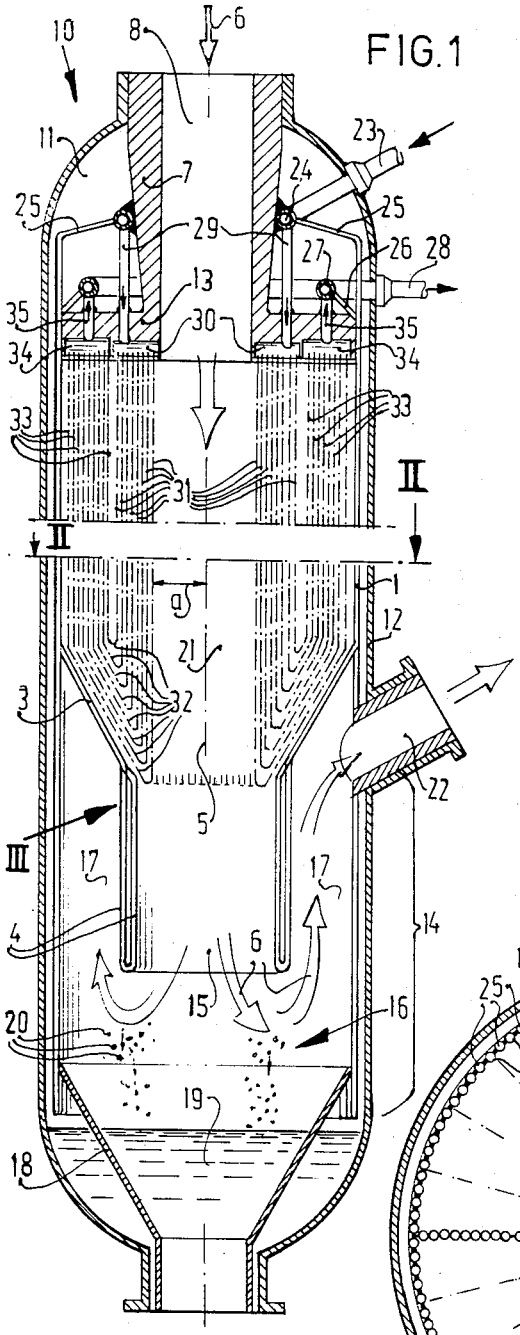
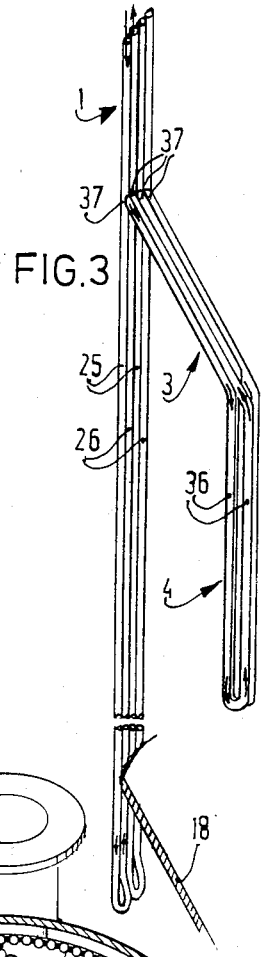
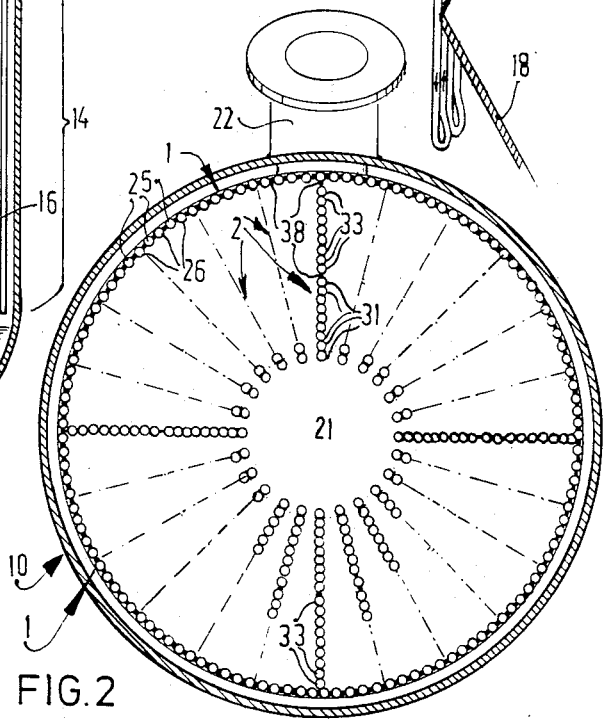
FIG.2

VERTICAL RADIATION TANK

The invention relates to a vertical radiation tank, more particularly for gaining heat from process gases of ash-forming, carbon containing fuels, comprising a vessel provided inside its jacket with diaphragm pipe walls traversed by a coolant and bounding a flow space to be traversed by process gases having on the top side a central inlet for the process gas on the lower side an inverting space for inverging the direction of flow of the process gas and adjacent thereto an outlet for the cooled process gas, said inverting space being bounded by a water space for capturing ash particles locally separated. Such a vertical radiation tank is known and is intended for gaining process heat produced in gasification of ash-forming carbon-containing fuels.

The production of steam with the aid of heat produced in a process is usually difficult, particularly when fluid ash particles are carried along in high concentrations in the gaseous phase as is characteristic of gasification methods carried out under pressure, for example, the gasification of coal or ash-containing crude oil.

The gas is cooled in the radiation tank to a level at which the ash swept along is solidified. At the inversion of the direction the gas stream is largely separated in a water vessel arranged below in the radiation tank. The heat transfer mainly takes place by radiation. Since the temperature of the heat-exchanging surface is chosen to be sufficiently low adhesion of fluid ash particles to this surface does not occur so that, when the heat-exchanging surface is cleaned a sufficient number of times, for example, with the aid of soot blowers, soiling of this surface need not occur.

In the known vertical radiation tank for cooling the gas containing fluid ash particles the heat-exchanging surface is provided on the inner surface of the pressure vessel in which the heat exchange is performed. This has the disadvantage that relatively little heat-exchanging surface per unit of volume of the heat-exchanger can be provided.

There is furthermore known a vertical radiation tank in which a plurality of concentric, cylindrical heat-exchanging surfaces are used. The disadvantage thereof is that at the inversion of the gas stream from one cylindrical surface to the other cylindrical surface the gas often has such a high temperature that the ash has not yet solidified so that slagging of the heat-exchanging surface is possible at the place of inversion. In the known vertical radiation tanks for heat exchange distribution casings are used as distribution points for the coolant introduced on the underside into the heat-exchanger. This construction has the disadvantage that slag depositions may occur thereon, which are of an aggressive nature and possibly limit the lifetime of the distribution casings. The distribution casings are generally made from thick-walled material. An additional disadvantage is the occurrence of thermo-shock at the subjacent distribution casings due to water splashing from the water bath to said material. A further disadvantage is the need for arranging coolant supply pipes in the lower part of the radiation tank. For structural reasons it may be necessary to pass these supply pipes through the water bath below in the radiation tank, which is less desirable with a view to corrosion. A further disadvantage is that at the place of the separation between the downward gas stream and the gas stream rising from below a heat-exchanging surface is provided which can be less effectively cooled by current techniques because the connecting strips between the pipes forming the separation partition are necessarily either so large that they attain a high temperature or of such a configuration that ash accumulations of aggressive nature can readily occur. This may adversely affect the lifetime of said surface.

The invention has for its object to mitigate the aforesaid disadvantages. For this purpose the diaphragm pipe walls comprise a cylindrical first diaphragm pipe wall concentric with the jacket of the vessel and extending over the length of the flow and the inverting space, a plurality of second diaphragm pipe walls radially arranged inside thereof, a third diaphragm pipe wall bounding the radial pipe walls on the underside and a short, cylindrical fourth diaphragm pipe wall adjoining the funnel-shaped diaphragm pipe wall, the third and fourth pipe walls being formed by pipes branched from the first diaphragm pipe wall. In this way the overall heat-exchanging surface per unit of volume of the vertical radiation tank has materially increased so that the dimensions of the radiation tank can be reduced. When the radial pipe walls terminate at a radial distance from the centre line of the vertical radiation tank, it remains possible to transport the fluid ash contained in the gas in a vertical direction towards the water bath.

The heat-exchanging diaphragm pipe walls are preferably formed by cylindrical pipes arranged side by side and provided with interconnected ribs. The coolant flows through the cylindrical pipes preferably in a first instance in a vertical, downward direction and subsequently in a vertical upward direction in a pipe, which may be adjacent the former as the case may be and is connected with the downcomer pipe. As a result the collecting casings in the lower part of the radiation tank as well as the lower supply pipes for the coolant can be dispensed with. In order to ensure the flow of the coolant it is necessary to use compulsory circulation of the coolant by means of a pump.

Since in accordance with the above principle compulsory circulation is employed, the separation between the downward and upward gas flows can be obtained with the aid of T-section pieces arranged in the cylindrical pipes so that a more effective cooling of the heat-exchanging surface can be ensured, which is conducive to the lifetime of this surface.

The invention will be described more fully with reference to a drawing.

The drawing schematically shows in:

FIG. 1 a vertical sectional view of a prefe embodiment of a vertical radiation tank in accordance with the invention, FIG. 2 a sectional view taken on the line II—II in FIG. 3, and FIG. 3 a perspective view of a possible embodiment of detail III of FIG. 1.

The vertical radiation tank 10 embodying the invention comprises a vessel 11 bounded by a jacket 12 and internally provided with diaphragm pipe walls traversed by a coolant. These diaphragm pipe walls comprise a cylindrical, first diaphragm pipe wall 1 covering the major part of the length of the vessel; a plurality of second pipe walls 2 radially arranged inside the former, terminating at a radial distance a from the centre line of the radiation tank 10 and thus leaving free a central, cylindrical, unhindered vertical passage for process gas, a third, funnel-shaped diaphragm pipe wall 3 bounding the radial pipe walls 2 on the underside, and a short, cylindrical, fourth diaphragm pipe wall 4.

A hot stream of process gas enters in the direction of the arrow 6 a gas inlet 8 provided in the upper part of the radiation tank 10 and bounded by a brick-lagged insulating wall 7 and then arrives at a vertical flow space 21, which is bounded by the diaphragm pipe walls 1 and 3 and the lagged upper wall 13, the pipe walls 2 being arranged therein. Below the flow space 21 an inverting space 14 is formed by a short, cylindrical flow channel 15, bounded by the diaphragm pipe wall 4, an outlet space 17 between the diaphragm pipe walls 1 and 4 and a separation space 16 arranged between the former and bounded by a water container 18 with water 19. When the gas flow is turned through 180° in the direction of the arrows 6 the ash particles 20 are separated out for the major part and captured in the water 19. With the effluent space 17 is connected at least one outlet 22 for cooled gases. The coolant, for example, water is supplied to the radiation tank 10 through at least one coolant inlet 23, which communicates with a surrounding collecting duct 24, from which extend pipes 25, which extend downwards in the diaphragm pipe wall 1 and turn through 180° via a hairpin bend below in the vessel 11 and are directed upwards at the side of the downcomers to terminate as pipes 26 in a surrounding collecting duct 27 having at least one outlet 28. Likewise connecting pipes 29 extend from the collecting duct 24 towards collecting ducts 30, which feed downwardly extending pipes 31, which are also inverted via hairpin bends 32 and terminate as upwardly extending pipes 33 in collecting ducts 34. The latter are connected through connecting ducts 35 with the continuous duct 27.

The pipes 36 of the third and fourth diaphragm pipe walls 3 and 4 are connected at T-section connections with pipes 25 and 26 of the diaphragm pipe wall 1. Since the coolant systems of the pipe walls 1, 2, 3 and 4 do not comprise collecting ducts below in the radiation tank 10 at the lower temperature of the process gases, deposition of particles and hence slag formation are avoided.

From FIG. 2 it is in particular apparent that the diaphragm pipe walls 1, 3 and 4 comprise a series of pipes 25, 26 and 36 respectively, which are interconnected by steel strips 38 bridging the interstices and each pipe wall 2 comprises a series of pipes 31 and 33, which are interconnected or not interconnected by metal strips 38.

I claim:

1. A vertical radiation tank (10), more particularly for gaining heat from process gases of ash forming, carbon containing fuels, comprising a vessel (11) provided inside its jacket with diaphragm pipe walls (1) traversed by a coolant and bounding a flow space to be traversed by process gases, said space having at the top a central inlet for the process gas, on the lower side an inverting space for inverting the direction of flow of the process gas and adjacent thereto at least one outlet for the cooled process gas, said inverting space being bounded by a water space for capturing therein locally separated ash particles characterized in that the diaphragm pipe walls comprise a cylindrical, first diaphragm pipe wall concentric with the jacket of the vessel and covering the length of the flow space and the inverting space, a plurality of second pipe walls radially arranged inside the former, a funnel-shaped, third diaphragm pipe wall (3) bounding the radial pipe walls (2) on their underside and a short, cylindrical fourth diaphragm pipe wall adjoining the funnel-shaped diaphragm pipe wall, the third and fourth diaphragm pipe walls being formed by pipes branched from the first diaphragm pipe wall, the cylindrical first diaphragm pipe wall is formed by U-section pipes lying wholly or partly side by side, one limb of which at the top is connected with an annular collecting duct for the water supply and the other limb is connected with an annular collecting duct for the water outlet and the radial second pipe walls are formed by a plurality of co-planar U-section pipes, one limb of which at the top is connected with a collecting duct for the water supply and the other limb is connected with a collecting duct for the water outlet.

2. A vertical radiation tank as claimed in claim 1, characterized in that the collecting ducts are connected with a water circulation system having compulsory circulation.

3. A vertical radiation tank as claimed in claim 1, characterized in that the radial pipe walls (2) terminate at a radial distance a from the centre line (5) of the vertical radiation tank.

* * * * *